US006368160B2

(12) United States Patent
Chang

(10) Patent No.: US 6,368,160 B2
(45) Date of Patent: Apr. 9, 2002

(54) ELECTRICAL CONNECTOR ASSEMBLY HAVING AN ANTI-MISMATING MECHANISM

(75) Inventor: Jen Jou Chang, Yung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/741,124

(22) Filed: Dec. 18, 2000

(30) Foreign Application Priority Data

Jul. 12, 2000 (TW) ..... 089212004

(51) Int. Cl.[7] ..... H01R 24/00
(52) U.S. Cl. ..... 439/676; 439/159; 439/677
(58) Field of Search ..... 439/676, 159, 439/160, 152, 680, 677

(56) References Cited

U.S. PATENT DOCUMENTS 6,022,246 A * 2/2000 Ko ..... 439/680
6,106,335 A * 2/2000 Merchant et al. ..... 439/676

* cited by examiner

*Primary Examiner*—Gary Paumen
(74) *Attorney, Agent, or Firm*—Wei Te Chung

(57) ABSTRACT

An electrical connector assembly (1) comprises a plug (5) and a modular jack (2). The modular jack comprises a housing (10) defining a front opening (12) and a receptacle space (11) in communication with the front opening. A terminal module (20) is received in said receptacle space and includes a base (22) and terminals (21) held in the base, each terminal including a contact portion (21*a*) extending rearward and upward from the base. An anti-mismating mechanism (40) received in the receptacle space comprises a front girder (43) forming a slanted supporting portion (431) abutting against the contact portions of the terminals, force receiving portions (41) formed on opposite ends of the supporting portion and adapted to be pushed by the complementary plug, and a resilient member (45) exerting a forward pushing force against the supporting portion.

1 Claim, 7 Drawing Sheets

ELECTRICAL CONNECTOR ASSEMBLY HAVING AN ANTI-MISMATING MECHANISM

BACKGROUND OF THE INVENTION

1. Field of the Invention

The present invention relates to an electrical connector used in a computer communication network, and more particularly, to an RJ-45 modular jack connector, which has an anti-mismating mechanism for preventing insertion of an RJ-11 modular plug thereinto.

2. Description of the Related Art

RJ-45 connector assemblies comprising a plug and a mateable jackare used in computer communication networks, while RJ-11 connector assemblies have a similar but smaller configuration and are used in wire telephone networks. A plug of an RJ-11 connector assembly could be incorrectly inserted into a receptacle connector of an RJ-45 connector assembly, if no anti-mismating mechanism were provided in the RJ-45 receptacle connector. Such a mismating could result in damage to the host devices connected to the connectors.

Referring to FIG. 7, U.S. application Ser. No. 09/536,165, which has the same assignee as the present invention, disclosed another RJ-45 receptacle connector 7. The receptacle connector 7 includes a housing 70, a terminal module 72 and an anti-mismating mechanism 73. The housing 70, covered by a shell 74, defines a receptacle space 71 for receiving a mating plug connector (not shown) therein. The terminal module 72 is arranged in the housing 70 for mating with the mating connector. The Anti-mismating mechanism 73 is arranged at the entrance of the receptacle space 71 for preventing insertion of a mismateable connector. However, because the anti-mismating mechanism is placed between the terminal module 72 and a front face 75, the receptacle space 71 must be constructed large enough to accommodate the anti-mismating mechanism 73, thereby accordingly expanding the overall size of the receptacle connector 7. In addition, the anti-mismating mechanism 73 may fall out after repeated insertion and withdrawal of the plug connector from the receptacle connector.

Hence, an improved receptacle connector is required to overcome the disadvantages of the related art.

BRIEF SUMMARY OF THE INVENTION

A main object of the present invention is to provide an RJ-45 connector, which has an anti-mismating mechanism for preventing insertion of a mismateable electrical connector.

Another object of the present invention is to provide an RJ-45 receptacle connector having an anti-mismating mechanism, which occupies a limited space and cannot fall out of the receptacle connector.

To fulfill the objects set forth, an RJ-45 connector assembly in accordance with the present invention comprises a plug and a modular jack. The modular jack comprises a housing defining a front opening and a receptacle space in communication with the front opening. A terminal module for securing to the housing includes a base and a plurality of terminals. Each terminal includes a contact portion extending into the receptacle space. An anti-mismating mechanism received in the receptacle space comprises a supporting portion located below the contact portions of the terminals, a resilient member exerting a forward pushing force against the supporting portion, and a force receiving portion formed on each of the lateral ends of the supporting portion, said force receiving portions being spaced from each other a distance substantially equal to a width of the receptacle space and adapted to be simultaneously pushed by the complementary modular plug when the plug is inserted into the receptacle space through the front opening of the housing.

When a mating plug is inserted into the modular jack, it pushes against the force receiving portions so that they move backward together with the supporting portion, which separates from the contact portion of the terminals. Therefore, it allows the terminals to be pushed down, so that the plug connector can be inserted into the receiving place, connecting with the terminals. When a mismateable plug connector is inserted into the receptacle connector, it cannot push the anti-mismating mechanism out of the way. The supporting portion prevents the terminals from bending, so it both protects the terminals and prevents insertion of a mismatable plug connector.

DETAILED DESCRIPTION OF THE INVENTION

Figure 1:
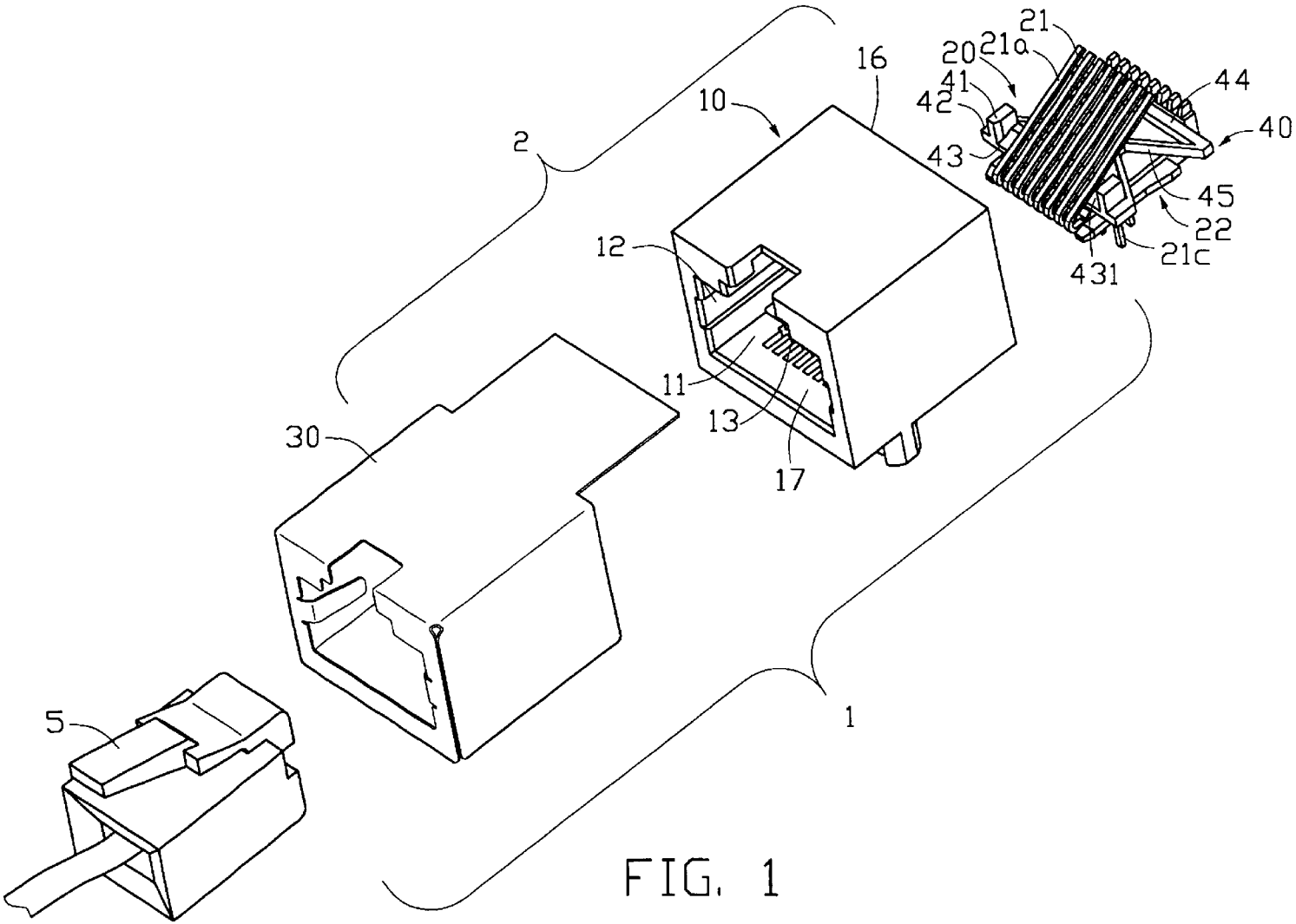
FIG. 1 is an exploded perspective view of an RJ-45 connector assembly in accordance with the present invention.
Figure 2:
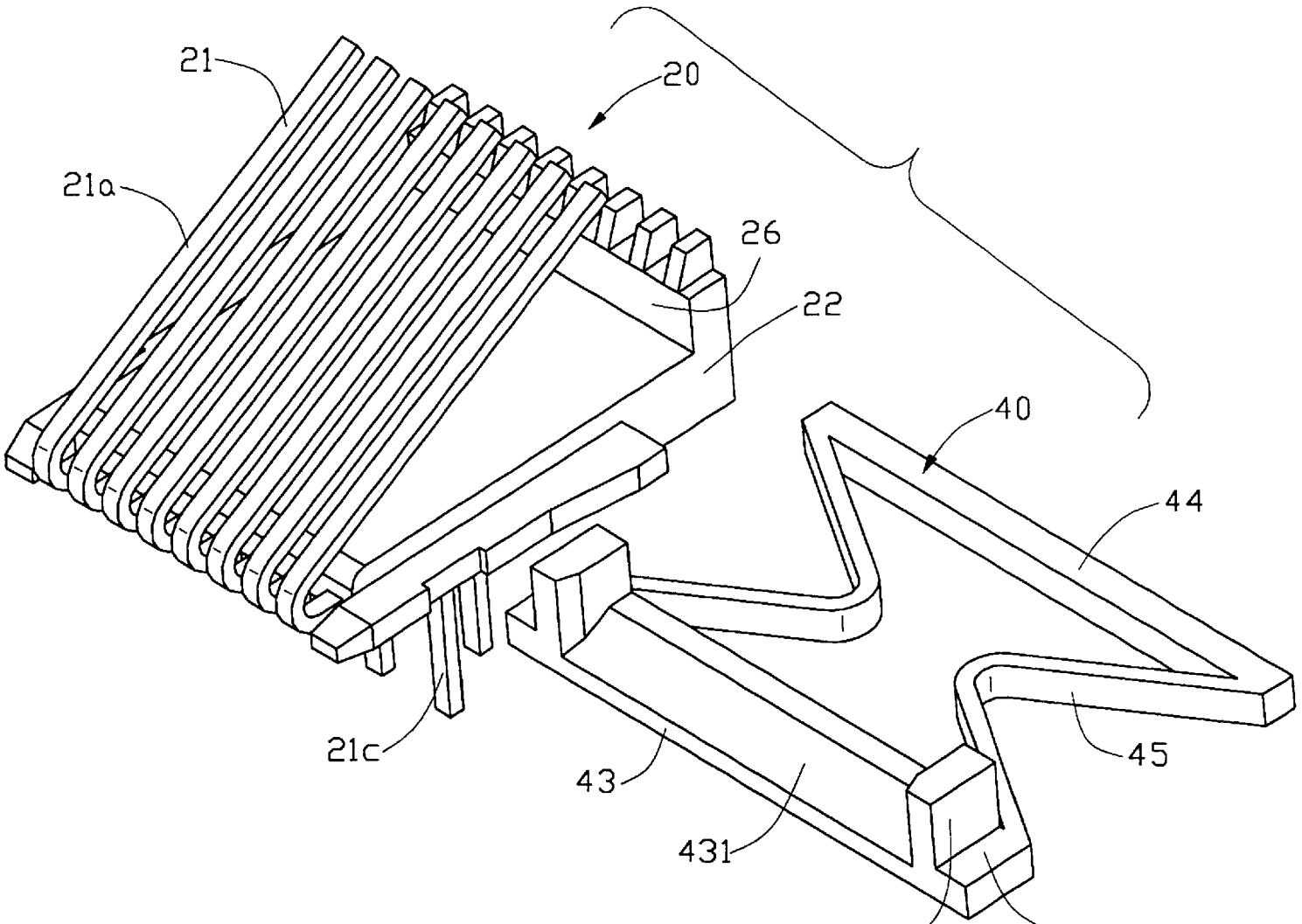
FIG. 2 is an exploded perspective view of anti-mismating mechanism and terminal module of the connector assembly of FIG. 1.
Figure 3:
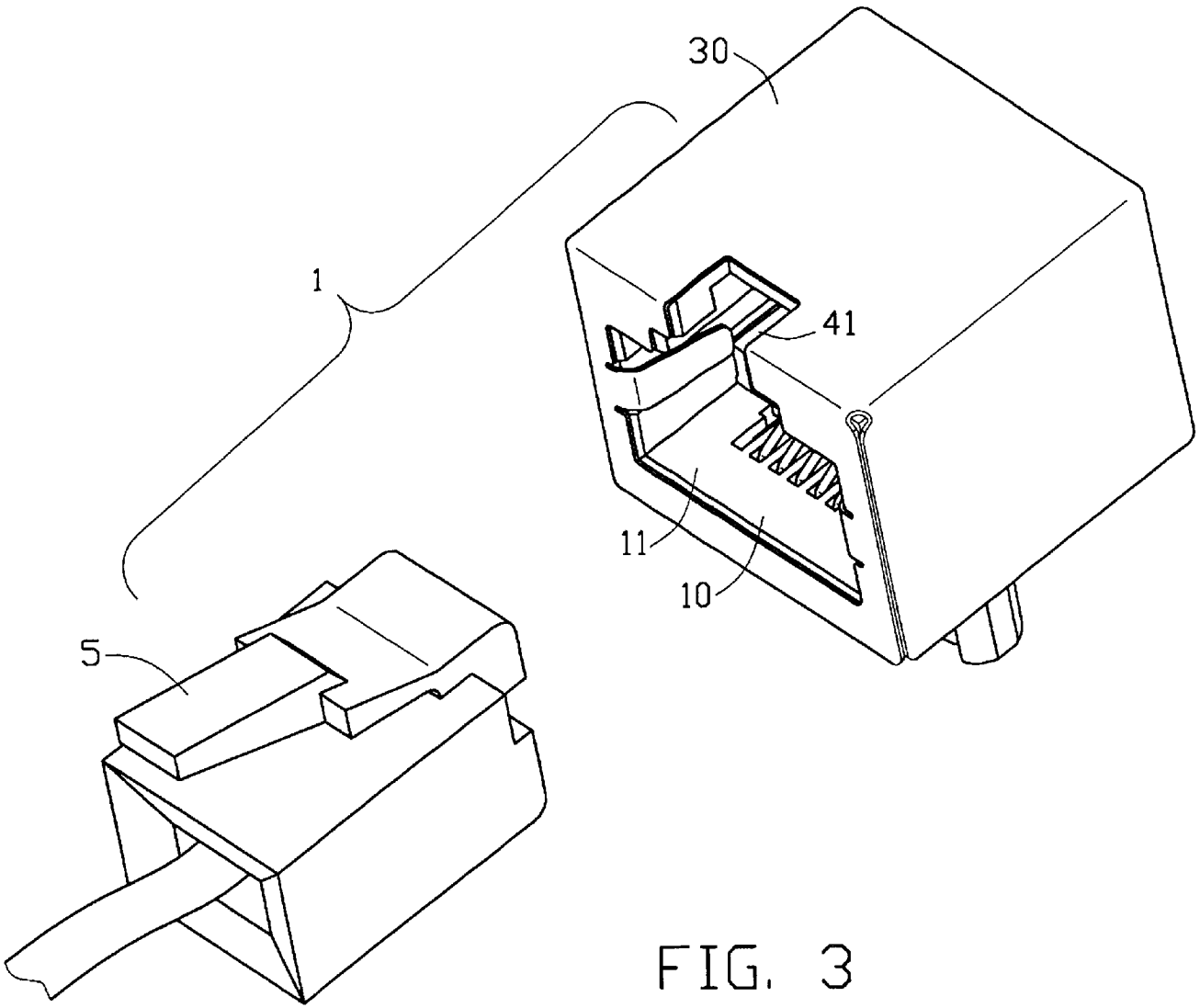
FIG. 3 is an exploded perspective view of the connector assembly of FIG. 1 wherein the modular jack is assembled together.

Referring to FIGS. 1 and 2, an RJ-45 connector assembly 1 of the present invention comprises a plug 5 and a modular jack 2 mateable with each other. The modular jack 2 includes a dielectric housing 10, a terminal module 20, an anti-mismating mechanism 40 to be mounted on the terminal module 20, and a conductive shield 30 for covering the housing 10.

The dielectric housing 10 defines a front opening 12 and a receptacle space 11 in communication with the front opening 12 for receiving the anti-mismating mechanism 40 and the terminal module 20 therein. The dielectric housing 10 further defines a plurality of passageways 13 communicating with the receptacle space 11 in a bottom side 17 of the housing 10.

The terminal module 20 includes a base 22 and a plurality of terminals 21 held by the base 22. Each of the terminals 21 includes a retaining portion 21*b* (FIG. 4) insert molded in the base 22, a contact portion 21*a* extending upward and rearward from a front end of the retaining portion 21*b*, and a tail portion 21*c* extending downward from a rear end of the retaining portion 21*b*. The contact portion 21*a* and the tail portion 21*c* are adapted for mating with terminals of the plug connectors and for soldering to a printed circuit board (not shown), respectively.

The anti-mismating mechanism 40 includes a frontgirder 43 and a rear girder 44. The front girder 43 forms a supporting/abutment portion 431 at a middle section thereof. A force receiving portion 41 is formed on each of the lateral ends of the supporting portion 431. The supporting portion 431 inclines parallel to the contact portions 21*a* of the terminals 21 for properly supporting the contact portions 21*a* when the anti-mismating mechanism 40 and the terminal module 20 are assembled together in the receptacle space 11 of the housing 10. A resilient member 45 connects opposing lateral ends of the front and rear girders 43, 44 and acts to exert a forward pushing force against the supporting portion 431. The distance between the inner sides of the force receiving portions 41 is larger than a width of an RJ-11 plug, while the distance between outer sides of the force receiving portions 41 is substantially equal to a width of the RJ-45 plug 5 and the receptacle space 11 of the housing 10.

In assembly, referring to FIGS. 1 to 4, the anti-mismating mechanism 40 is assembled to the base 22 of the terminal module 20. The supporting portion 431 of the front girder 43 abuts against the contact portions 21*a* at a position near the retaining portions 21*b* of the terminals 21. The rear girder 44 abuts against a rear wall 26 of the base 22. The terminal module 20 is then inserted into the receptacle space 11 from the rear face 16 of the housing 10. Shoulders 42 of the anti-mismating mechanism 40 are sidebly received in the housing 10. The retaining portions 21*b* of the terminals are received in corresponding passageways 13 and the contact portions 21*a* extend into the receptacle space 11. The shield 30 is finally mounted to and covers the housing 10.

Figure 4:
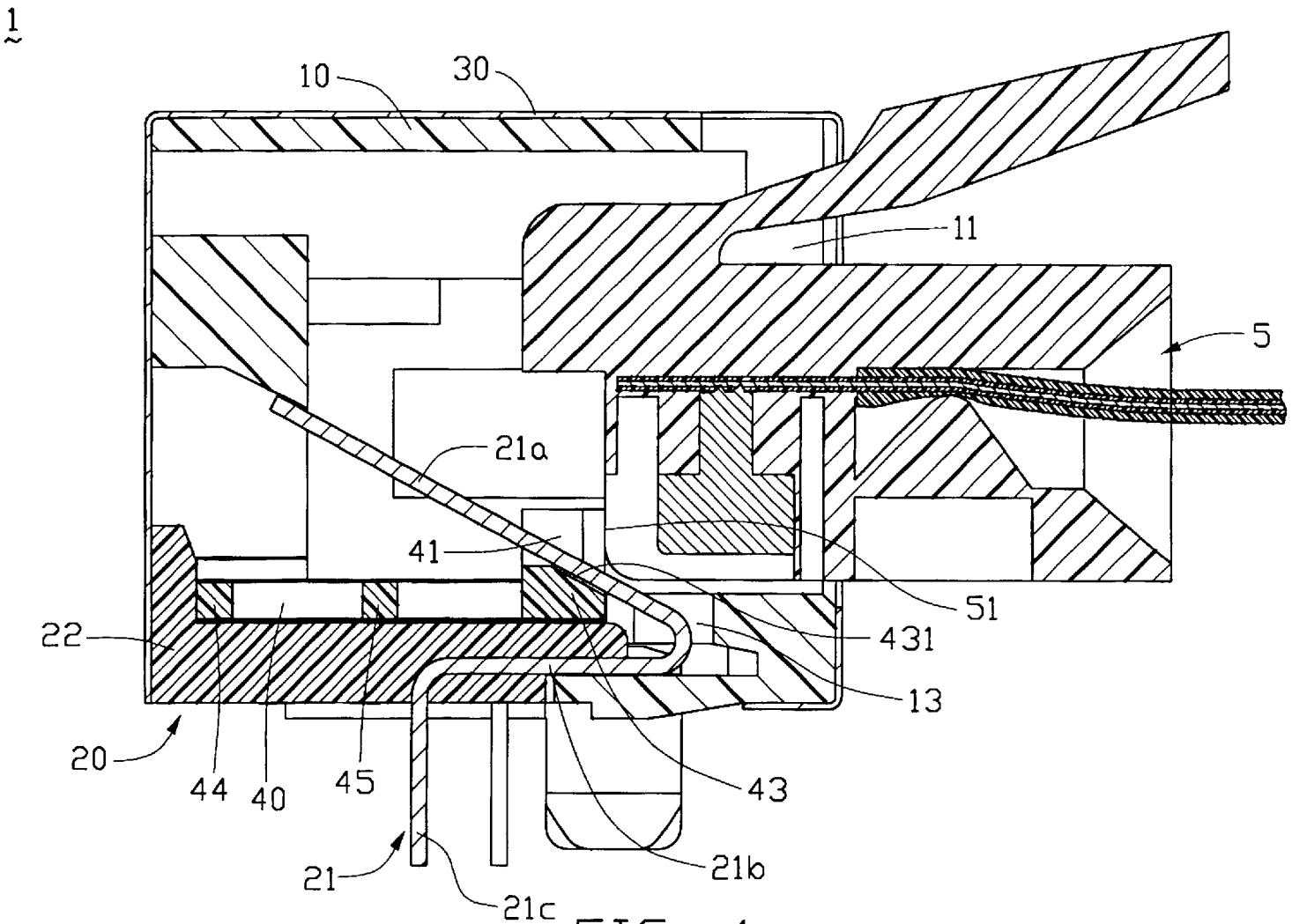
FIG. 4 is a cross-sectional view of the connector assembly of FIG. 3 wherein the plug is inserted into the jack at a first position.
Figure 5:
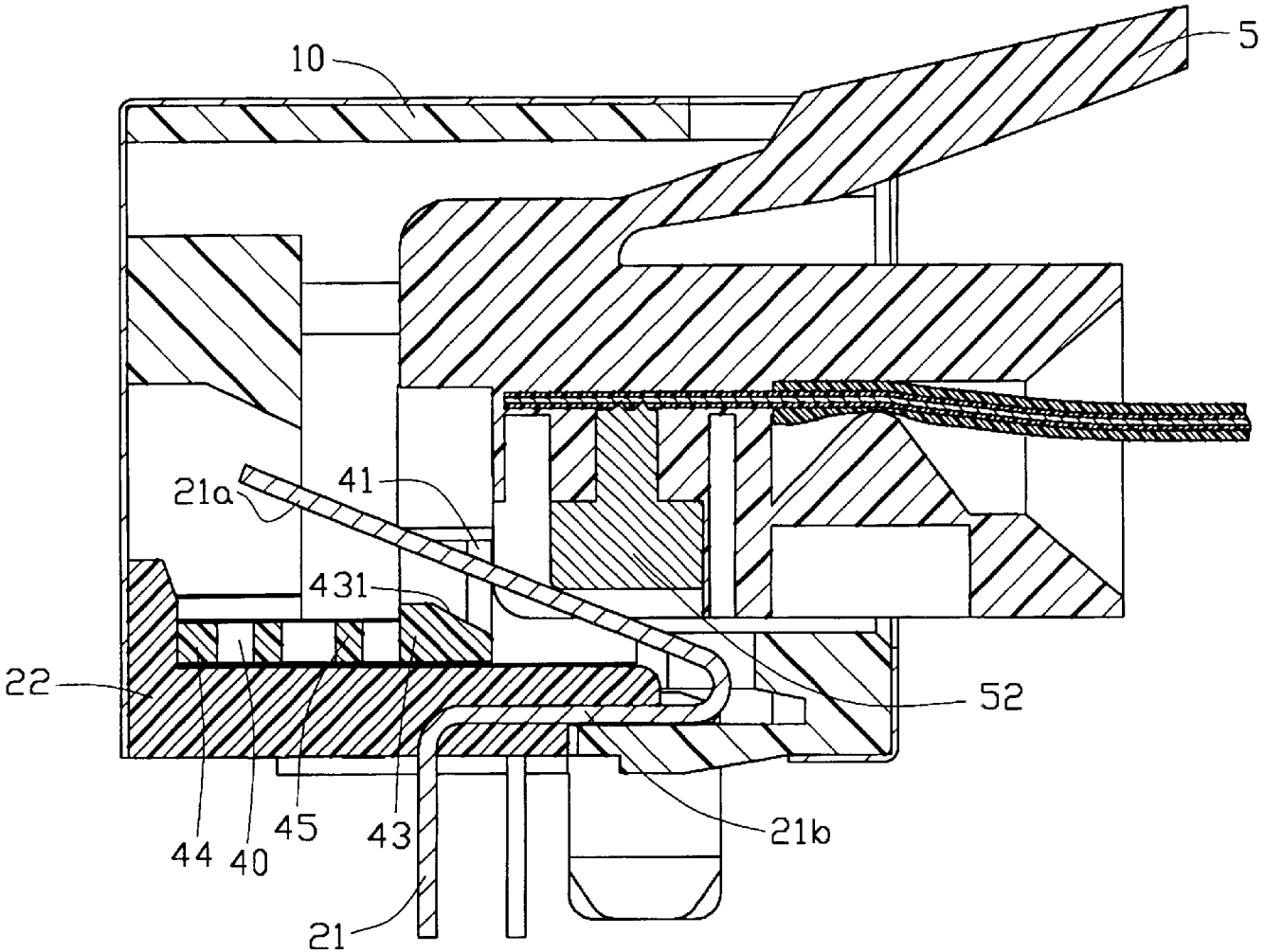
FIG. 5 is a cross-sectional view similar to FIG. 4 with the plug at a second position.
Figure 6:
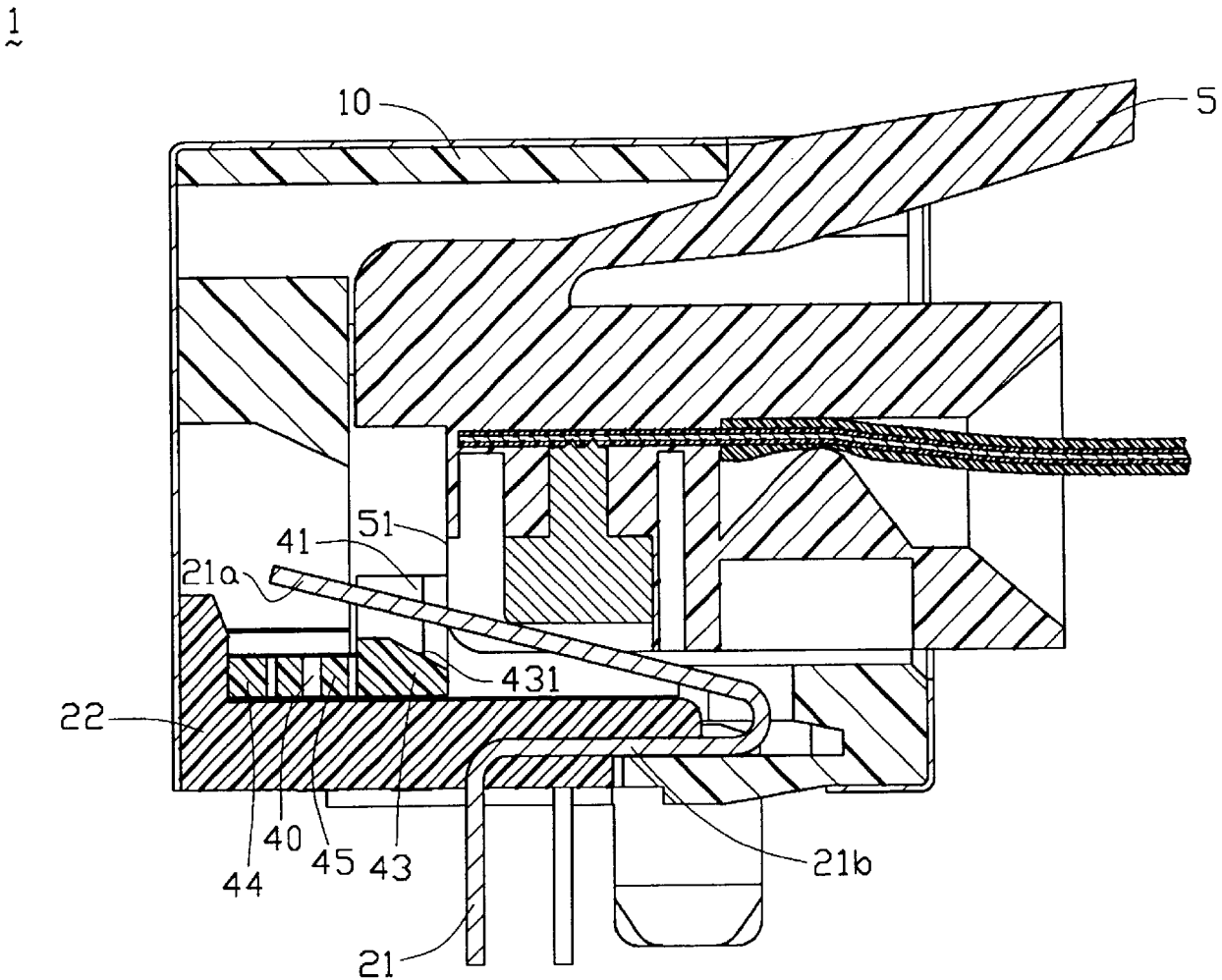
FIG. 6 is a cross-sectional view similar to FIG. 4 with the plug at a fully inserted position.
Figure 7:
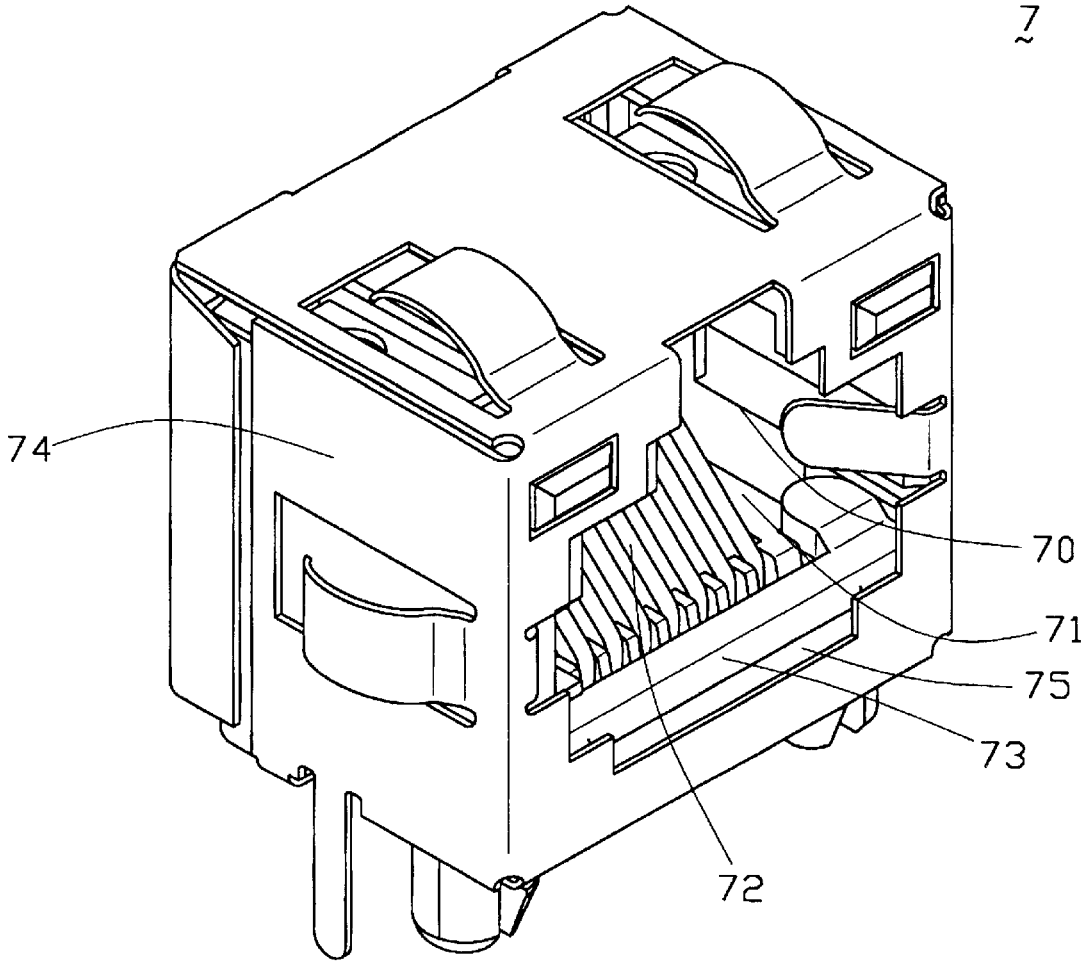
FIG. 7 (RELATED ART)
FIG. 7 is a perspective view of a related art receptacle connector.

When the RJ-45 plug 5, i.e., the larger type, is inserted into the receptacle space 11 from the front opening 12 of the housing 10, an insertion end 51 of the plug 5 first pushes against the force receiving portions 41 of the front girder 43 (FIG. 4). The pushing force results in the resilient members 45 being resiliently bent rearward as the front girder 43 moves rearward. As this occurs, the supporting portion 431 of the front girder 43 moves away from the contact portions 21*a* of the terminals 21 (FIG. 5). A further insertion of the plug 5 causes the contact portions 21*a* to move downward toward the retaining portions 21*b* until the plug 5 is completely connected with the modular jack 2 (FIG. 6). At this position, the contact portions 21*a* exert a sufficient normal force against the contacts 52 of the plug 5 to establish an electrical connection between the plug 5 and the modular jack 2.

When a mismateable connector, such as an RJ-11 plug, i.e., the smaller type, is mistakenly inserted into the modular jack 2, it cannot simultaneously push both of the force receiving portions 41 of the anti-mismating mechanism 40 since its width is smaller than the distance between the inner sides of the force receiving portions 41 of the anti-mismating mechanism 40. As mentioned above, the distance between the outer sides of the blocks 41 is substantially the same as a width of the receptacle space 11. Therefore, the 20 front girder 43 cannot be moved a significant distance rearward if only one of the force receiving portions 41 is pushed by the erroneously inserted RJ-11 plug since a lateral end of the front girder 43 which is not pushed will jam against a corresponding side wall of the housing 10. In this way, any mismateable connector is effectively prevented from fully inserting into the receptacle connector 2 by the anti-mismating mechanism 40 of the present invention. Furthermore, the anti-mismating mechanism 40 is reliably retained in the receptacle space of the receptacle connector 2 without the danger of falling out.

It is to be understood, however, that even though numerous characteristics and advantages of the present invention-have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack adapted to mate with a complementary modular plug, comprising:

an insulative housing defining a front opening and a receptacle space in communication with the front opening;

a number of terminals retained in the housing, each terminal including a contact portion extending into the receptacle space;

an anti-mismating mechanism received in the receptacle space, comprising a supporting portion located below the contact portions of the terminals, a resilient member exerting a forward pushing force against the supporting portion, and a force receiving portion formed on each of lateral ends of the supporting portion, said force receiving portions being spaced from each other a distance substantially the same as a width of the receptacle space and adapted to be simultaneously pushed by the complementary modular plug when the plug is inserted into the receptacle space through the front opening of the housing;

wherein each terminal further includes a retaining portion insert molded in a base;

wherein each terminal further includes a tail portion extending downwardly from an end of said retaining portion opposite an end attached to said contact portion;

wherein said anti-mismating mechanism further includes a front girder formed beneath the supporting portion and the force receiving portions, and a rear girder abutting against a rear wall of the base, the resilient member connecting opposing lateral ends of said front and rear girders.

* * * * *